US005845586A

United States Patent [19]

Moore

[11] Patent Number: 5,845,586

[45] Date of Patent: Dec. 8, 1998

[54] ERGONOMIC WORKSTATION

[75] Inventor: Lorraine Moore, Cameron, Tex.

[73] Assignee: Balt, Inc., Cameron, Tex.

[21] Appl. No.: 924,041

[22] Filed: Aug. 28, 1997

[51] Int. Cl.[6] ..... A47B 35/00

[52] U.S. Cl. ..... 108/50.01; 108/9

[58] Field of Search ..... 108/50.01, 50.02, 108/153.1, 155, 157.1, 1, 6, 9; 248/188.1; 312/195, 223.6

[56] References Cited

U.S. PATENT DOCUMENTS

| | | | |
|---|---|---|---|
| 5,357,873 | 10/1994 | Hilton | 108/50.01 |
| 5,490,466 | 2/1996 | Diffrient | 108/50.01 X |
| 5,522,323 | 6/1996 | Richard | 108/50.01 X |
| 5,568,773 | 10/1996 | Hung | 108/50.01 X |
| 5,623,881 | 4/1997 | Huang | 108/50.01 |
| 5,704,299 | 1/1998 | Corpuz, Jr. et al. | 108/50.01 |
| 5,730,408 | 3/1998 | McAllister et al. | 248/918 X |

*Primary Examiner*—Jose V. Chen

*Attorney, Agent, or Firm*—Wendy K. Buskop; Chamberlain, Hrdlicka et al.

[57] ABSTRACT

A computer workstation that has an adjustable keyboard support is described. The workstation has a base having an upper end, a lower end, and a leg assembly. There is top having a bottom surface attached to the upper end of the base. A keyboard support having a longitudinal axis is pivotally attached to the top. The workstation is designed so that the keyboard support can be adjusted in height as well as angularly.

28 Claims, 4 Drawing Sheets

ERGONOMIC WORKSTATION

BACKGROUND

In one aspect, the present invention relates to a workstation with keyboard support means that can be adjusted in height as well as angularly.

Computers are a part of almost every work environment. A variety of workstations have been designed to accommodate computers and related paraphernalia such as printers in the work place. The user is often required to sit at a workstation for several hours at a time. Most workstations are limited in the type of adjustments that can be made. This environment creates a situation were the user is subject to fatigue and wrist strain due to the position of the keyboard in relation to the user. A workstation with a keyboard support means that is adjustable in height would be very useful.

Another problem inherent with computer workstations is that the keyboard support is usually positioned at a fixed angle with respect to the computer support or table top. Many times, this fixed angle is not comfortable for an individual user. The angle of the keyboard support may cause strain on the wrists and hand of the user, increasing the chance for injury to the user, as well as reducing productivity. A workstation with a keyboard support that is adjustable in angle with respect to the computer support would be highly desirable.

Many computer workstations do not provide enough room for the user to comfortably sit in front of the computer. A workstation that provides room for the user's legs would be very desirable.

OBJECTS OF THE INVENTION

It is an object of the present invention to provide a workstation that has a keyboard support that is adjustable in height.

It is another object of the present invention to provide a workstation where the keyboard support is angularly adjustable with respect to the centerline of the keyboard.

It is yet another object of the present invention to provide a workstation that accommodates a users legs in a sitting position.

SUMMARY

The present invention is directed to a computer workstation that has an adjustable keyboard support means. The workstation has a base having an upper end, a lower end, and a leg assembly that is generally Z-shaped. A top having a bottom surface is attached to the upper end of the base. A keyboard support means having a longitudinal axis is pivotally attached to the top. The workstation is designed so that the keyboard support means can be adjusted in height as well as angularly so as to provide an adjustable keyboard support means that alleviates the above referenced deficiencies in the currently available workstations.

DETAILED DESCRIPTION OF THE PREFERRED EMBODIMENTS

Figure 1:
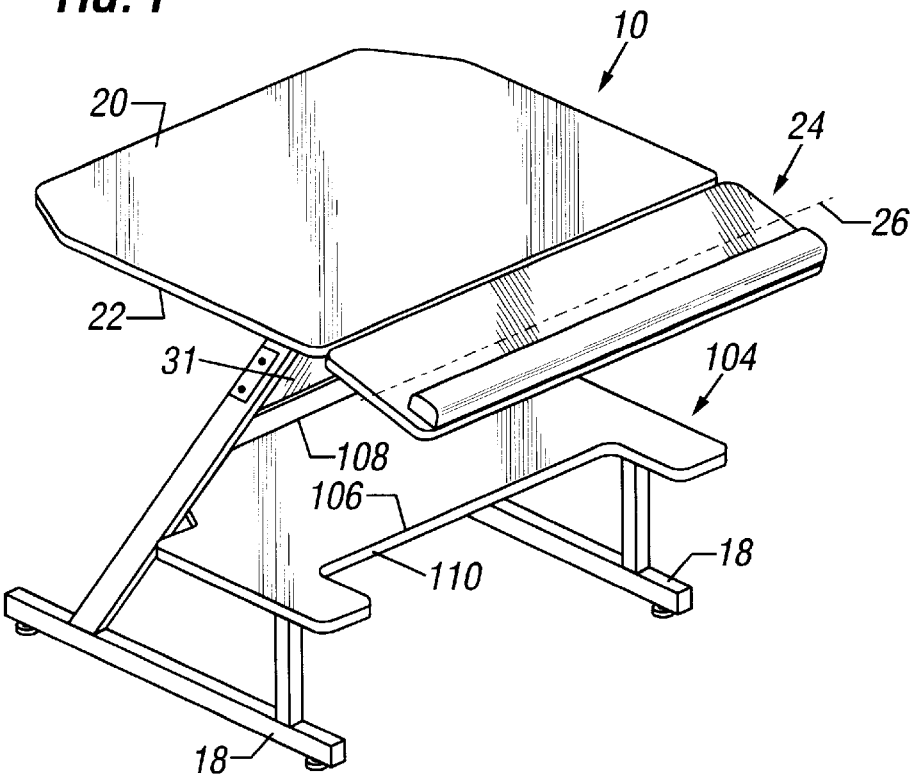
FIG. 1 is a perspective view of the workstation.
Figure 2:
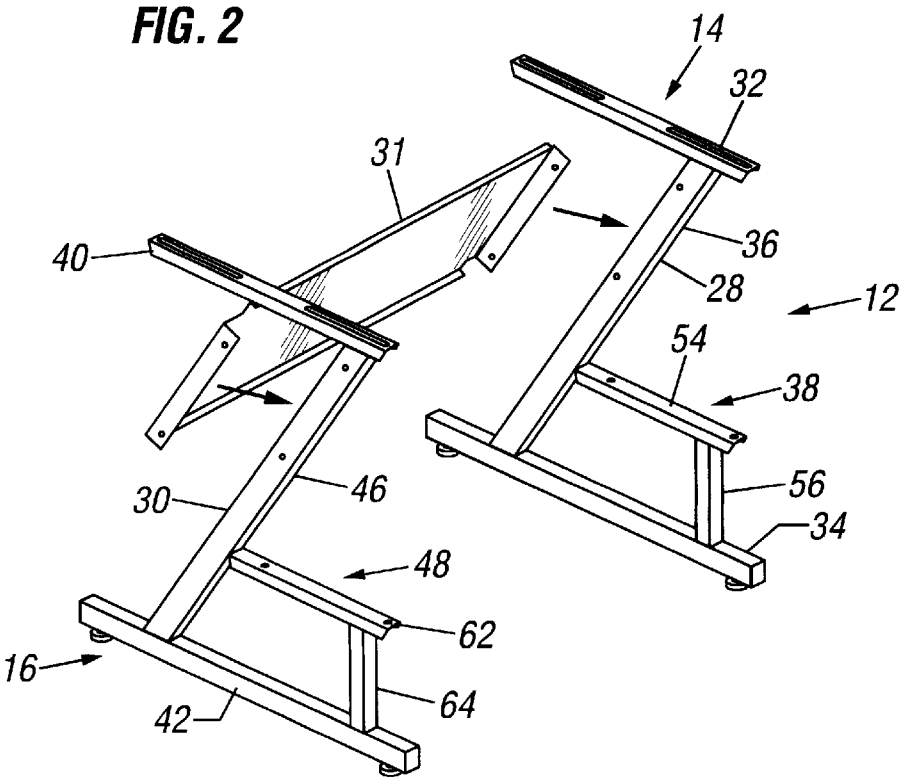
FIG. 2 is a perspective view of the base of the workstation shown with the top removed.

In the illustrated embodiment, the present invention provides for a workstation where the keyboard support is adjustable from two different reference points. The apparatus 10, referred to herein as workstation, has a base 12 with an upper end 14, a lower end 16, and a leg assembly 18 that is preferably generally Z-shaped as shown in FIGS. 1 and 2. There is a top 20 having a bottom surface 22 attached to the upper end 14 of the base 12 and a keyboard support means 24 having a longitudinal axis 26 that is pivotally attached to the top 20. The top 20 and the keyboard support means 24 can be attached to any type of base 12 such as a table.

Preferably, the leg assembly 18 comprises a first leg 28 connected to a second leg 30 by a support means 31 as shown in FIG. 2. The first leg 28 and the second leg 30 are generally Z-shaped and the first leg 28 is parallel to and in juxtaposition with the second leg 30. The first leg 28 has an upper portion 32 connected to a lower portion 34 by a column portion 36 and a first brace means 38 positioned between the column portion 36 and the lower portion 34 of the first leg 28. The second leg 30 has an upper portion 40 connected to a lower portion 42 by a column portion 46 and a second brace means 48 positioned between the column portion 46 and the lower portion 42 of the second leg 30. The upper portion, lower portion, and the column portion of each of first and second legs 28 and 30 form a Z-shape. The leg assembly 18 can also be rectangular or another shape that supports the top 20 and the keyboard support means 24.

The support means 31 is preferably attached to the column portion 36 of the first leg 28 and the column portion 46 of the second leg 30. The support means 31 provides the necessary stability for the first and second legs 28 and 30. The sheet metal plate forms a suitable support means 31.

As shown in FIG. 2, the first brace means 38 can be in the form of an L-shaped leg having a top portion 54 and a bottom portion 56. The top portion 54 is attached to the column portion 36 of the first leg 28 and the bottom portion 56 is attached to the lower portion 34 of the first leg 28. The top portion 54 of the first brace means 38 is positioned generally parallel to the upper portion 32 of the first leg 28. The second brace means 48 can also be in the form of an L-shaped leg having a top portion 62 and a bottom portion 64. The top portion 62 is attached to the column portion 46 of the second leg 30 and the bottom portion 64 is attached to the lower portion 42 of the second leg 30. The top portion 62 of the second brace means 48 is positioned generally parallel to the upper portion 40 of the second leg 30.

Figure 3:
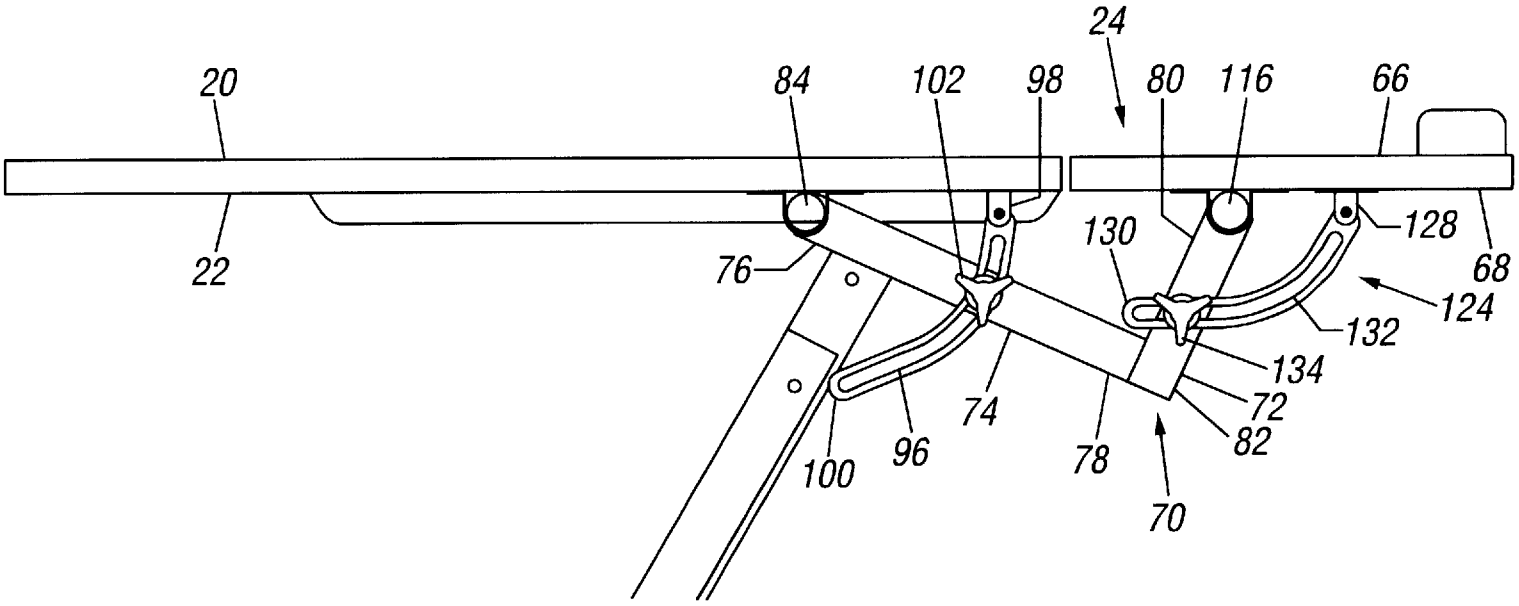
FIG. 3 is a side view of the workstation.

The keyboard support means 24 preferably has an upper surface 66 and a bottom surface 68. The bottom surface 68 of the keyboard support means 24 is mounted to the bottom surface 22 of the top 20 by a generally L-shaped mounting means 70 as illustrated in FIG. 3. The generally L-shaped mounting means 70 has a short arm 72 connected to a long arm 74. It is preferred that the longitudinal axis 26 of the keyboard support means 24 extend generally alongside the top 20.

In a preferred embodiment, the long arm 74 has a first end 76 and a second end 78 and the first end 76 is pivotally connected to the bottom surface 22 of the top 20. The short arm 72 has a first end 80 connected to the bottom surface 68 of the keyboard support means 24 and a second end 82 connected to the second end 78 of the long arm 74.

Figure 4:
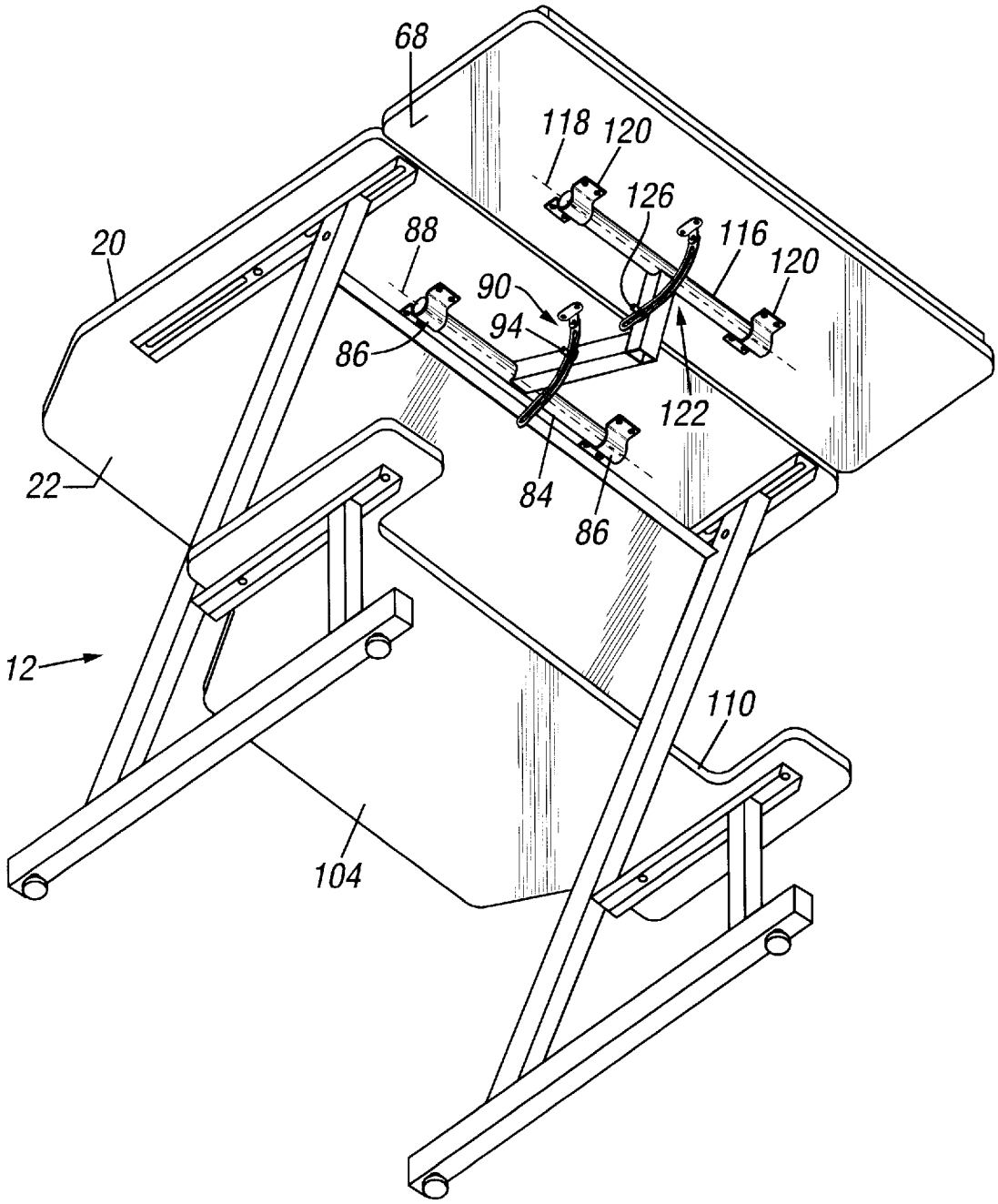
FIG. 4 is a bottom view of the workstation.

As illustrated in FIG. 4, the long arm 74 of the generally L-shaped mounting means 70 preferably has a first tubular member 84 attached to the first end 76 and forms a T-shaped head. In this preferred embodiment, the first tubular member 84 is rotatably mounted to the bottom surface 22 of the top 20 by a bracket means 86 that is fastened to the bottom surface 22 of the top 20. The first tubular member 84 has a longitudinal axis 88 and extends in a plane that is parallel to the longitudinal axis of the top 20. A pair of C-shaped brackets have been found to be a suitable bracket means for this purpose because they allow the tubular member 84 to rotate.

Figure 5:
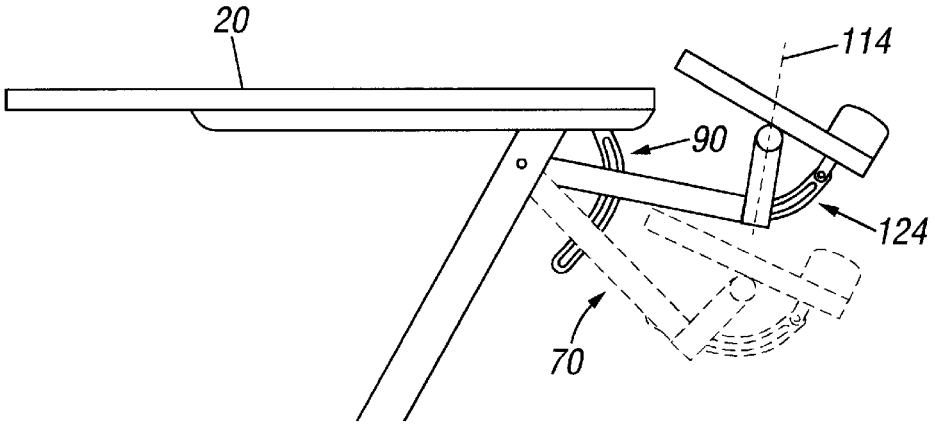
FIG. 5 is a side view of the workstation.
Figure 6:
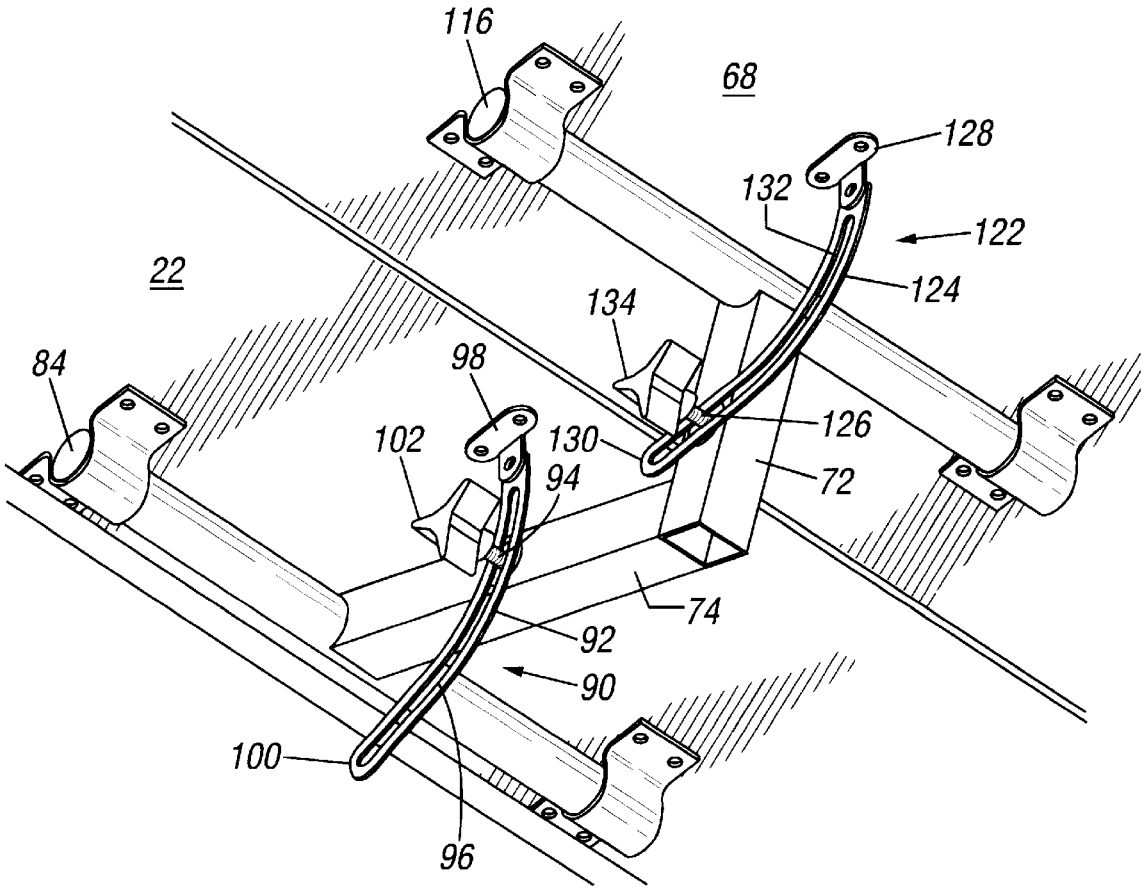
FIG. 6 is an enlarged view of FIG. 4.

Preferably, the long arm 74 is capable of rotating in a plane normal to the longitudinal axis of the top 20 via a first pivot means 90, so that the keyboard support means 24 can be adjusted in height by a user. (See FIG. 5) The keyboard support means 24 may be raised so that it is positioned in a plane that is above the top 20 to a comfortable level for a user that is standing in front of the workstation or lowered to a comfortable position for a user that is in a seated position as shown in FIG. 5.

The first pivot means 90 comprises a first elongated guide means 92 and a first shaft 94. The first shaft 94 is fixed to the long arm 74 of the generally L-shaped mounting means 70 between the first end and the second end. The first elongated guide means 92 has a first end 98, a second end 100 and a slot 96 extending between the first end 98 and the second end 100. The first end 98 is attached to the bottom surface 22 of the top 20 and a the slot 96 is slidably received by the first shaft 94. The first elongated guide means 92 can have a generally parabolic circular sector shape. The purpose of the elongated guide means is to lock the position of the keyboard support means so it can be adjusted in height by a user.

The first end of the first elongated guide means 92 can be pivotally attached to the bottom surface of the top. In this configuration, the first elongated guide means can pivot about the first end 98 as the L-shaped mounting means is being rotated about the axis of the first tubular member. The elongated guide means 92 does not necessarily need to be parabolic in shape, so long as the first end 98 is pivotally attached to the bottom surface 22. Alternatively, if the elongated guide means is not parabolic or semi-circular, the elongated guide means would necessarily need to be pivotally attached to the bottom surface 22 to adjust the position of the keyboard support means.

In use, the long arm 74 pivots about the longitudinal axis of the first tubular member 84 in a range of from about 10 degrees to about 45 degrees measuring from the bottom surface 22 of the top 20. The user adjusts the height of the keyboard support means 24 to a level that is comfortable and locks the first elongated guide means 92 place using a first locking means 102. The first locking means maintains the first elongated guide means 92 in a desired position. The first locking means can be simply a nut that threads on to the first shaft or a knob having a threaded portion for engaging the first shaft.

In yet another preferred embodiment, there is provided a shelf means 104 positioned in a plane parallel to the top 20. The shelf means 104 is attached to the first brace means 38 and the second brace means 48. The shelf means 104 has a front edge 106 and a back edge 108. The front edge 106 forms a recess 110 therein to accommodate the legs of a user. The shelf can be used to support a printer or other materials while providing a recess so that the user can comfortably sit in front of the workstation.

In another of the preferred embodiments, the first end 80 of the short arm 72 is preferably pivotally connected to the bottom surface 68 of the keyboard support means 24 and the second end 82 is connected to the second end of the long arm 74. The short arm 72 of the generally L-shaped mounting means 70 may have a second tubular member 116 having a longitudinal axis 118. The second tubular member 116 is similar to the first tubular member described above. The second tubular member 116 is attached to the first end 80 of the short arm 72 to form a T-shaped head. The second tubular member 116 is rotatably mounted to the bottom surface of the keyboard support means 24 by a bracket means 120 that is fastened to the bottom surface of the keyboard support means 24. The bracket means 120 can be a C-shaped bracket as described above that allows the keyboard support means 24 to rotate.

The keyboard support means 24 is capable of rotating about the longitudinal axis 118 of the second tubular member 116 in a plane that is normal to the longitudinal axis of the short arm 72, via a second pivot means 122, so that the centerline 112 of the keyboard support means 24 can be adjusted relative to the longitudinal axis 114 of the short arm 72 by a user. In this embodiment, the second pivot means 122 comprises a second elongated guide means 124 and a second shaft 126 similar the first pivot means described above. The second shaft 126 is fixed to the short arm 72 of the generally L-shaped mounting means 70 between the first end and the second end. The second elongated guide means 124 has a first end 128, a second end 130, and includes a slot 132 extending between the first end 128 and the second end 130. The first end 128 is attached to the bottom surface 68 of the keyboard support means 24 and a the second shaft 126 is slidably received by the slot 132. The second elongated guide means 124 preferably has a generally parabolic preferably circular sector, shape.

The second elongated guide means 124 can have a generally parabolic circular sector shape. The purpose of the elongated guide means 124 is to lock the position of the keyboard support means 24 so it can be adjusted angularly by a user.

The first end 128 of the second elongated guide means 124 can be pivotally attached to the bottom surface 68 of the keyboard support means 24. In this configuration, the second elongated guide means can pivot as the keyboard support means 24 is being rotated about the axis of the second tubular member. The elongated guide means 124 does not necessarily need to be parabolic in shape, so long as the first end 128 is pivotally attached to the bottom surface 68. Alternatively, if the elongated guide means 124 is not parabolic or semi-circular, the elongated guide means 124 would necessarily need to be pivotally attached to the bottom surface 68 to adjust the position of the keyboard support means.

In use, the keyboard support means 24 rotates in a range of from about 10 degrees to about 45 degrees measuring from the longitudinal axis of the short arm 72. Having the keyboard support means rotate about the second tubular member allows for the angular adjustment of the keyboard by a user. This reduces the potential for wrist strain on the user. The user can adjust the angle of the keyboard support means and lock the keyboard support means 24 in a desired position using a second locking means 134. The second locking means 134 is similar to the first locking means in that can be simply a nut that threads on to the second shaft or a knob having a threaded portion for engaging the second shaft.

I claim:

1. An apparatus comprising:

a base having an upper end, a lower end, and a leg assembly comprising legs that are generally Z-shaped;

and wherein the leg assembly comprises a first leg connected to a second leg by a support means, wherein said first leg and said second leg are generally Z-shaped, and wherein said first leg is parallel to and in juxtaposition with said second leg; and a top having a bottom surface attached to the upper end of the base; and a keyboard support means having a longitudinal axis pivotally attached to the top.

2. An apparatus as in claim 1, wherein said first leg has an upper portion connected to a lower portion by a column portion and a first brace means positioned between the column portion and the lower portion of the first leg; wherein said second leg has an upper portion connected to a lower portion by a column portion and a second brace means positioned between the column portion and the lower portion of the second leg, wherein the first portion, the second portion, and the column form a Z-shape.

3. An apparatus as in claim 2, wherein said first brace means forms an L-shaped leg having a top portion and a bottom portion, wherein the top portion is attached to the column portion of the first leg and the bottom portion is attached to the lower portion of the first leg, said top portion of said first brace means being positioned generally parallel to the upper portion of the first leg, wherein said second brace means forms an L-shaped leg having a top portion and a bottom portion, wherein the top portion is attached to the column portion of the second leg and the bottom portion is attached to the lower portion of the second leg, said top portion of said second brace means being positioned generally parallel to the upper portion of the second leg.

4. An apparatus as in claim 3, further comprising a shelf means positioned in a plane parallel to the top, wherein said shelf means is attached to the first bracket means and the second bracket means, said shelf means having a front edge and a back edge, wherein said front edge forms a recess therein to accommodate the legs of a user.

5. An apparatus as in claim 1, wherein the keyboard support means has an upper surface and a bottom surface, wherein said bottom surface of the keyboard support means is mounted to the bottom surface of the top by a generally L-shaped mounting means, said generally L-shaped mounting means having a short arm connected to a long arm, wherein said keyboard support means extends generally alongside the top.

6. An apparatus as in claim 5, wherein the long arm has a first end and a second end and said first end is pivotally connected to the bottom surface of the top, wherein said short arm has a first end pivotally connected to the bottom surface of the keyboard support means and a second end connected to the second end of the long arm.

7. An apparatus as in claim 6, wherein the long arm of the generally L-shaped mounting means has a first tubular member attached to the first end and forms a T-shaped head, wherein said tubular member is rotatably mounted to the bottom surface of the top by a bracket means that is fastened to the bottom surface of the top, wherein said tubular member has a longitudinal axis and extends in a plane that is parallel to the longitudinal axis of the top.

8. An apparatus as in claim 7, wherein said long arm is capable of rotating in a plane normal to the longitudinal axis of the top via a first pivot means, so that the keyboard support means can be adjusted in height by a user.

9. An apparatus as in claim 8, wherein said first pivot means comprises a first elongated guide member and a first shaft, said first shaft being fixed to the long arm of the generally L-shaped mounting means near the first end, said first elongated guide having a first end, a second end, and further including a slot extending between the first end and the second end, said first end being attached to the bottom surface of the top and a said slot being slidably received by the first shaft.

10. An apparatus as in claim 9, wherein said first elongated guide member has a generally parabolic shape.

11. An apparatus as in claim 9, wherein said first end of said first elongated guide member is pivotally attached to the bottom surface of the top.

12. An apparatus as in claim 9, wherein said long arm pivots about the longitudinal axis of the first tubular member in a range of from about 10 degrees to about 45 degrees measuring from the bottom surface of the top.

13. An apparatus as in claim 12, further comprising a first locking means for maintaining the first elongated guide means in a desired position.

14. An apparatus as in claim 5, wherein said short arm has a first end pivotally connected to the bottom surface of the keyboard support means and a second end connected to the second end of the long arm.

15. An apparatus as in claim 14, wherein the short arm of the generally L-shaped mounting means further comprises a second tubular member having a longitudinal axis, said second tubular member being attached to the first end of the short arm to form a T-shaped head, wherein said second tubular member is rotatably mounted to the bottom surface of the keyboard means by a bracket means that is fastened to the bottom surface of the keyboard support means.

16. An apparatus as in claim 15, wherein said keyboard support means is capable of rotating about the longitudinal axis of the second tubular member in a plane that is normal to the longitudinal axis of the short arm, via a second pivot means, so that the centerline of the keyboard support means can be adjusted relative to the longitudinal axis of the short arm by a user.

17. An apparatus as in claim 16, wherein said second pivot means comprises a second elongated guide member and a second shaft, said second shaft being fixed to the short arm of the generally L-shaped mounting means near the first end, said second elongated guide member having a first end, a second end, and further including a slot extending between the first end and the second end, said first end being attached to the bottom surface of the top and a said second shaft being slidably received by the slot.

18. An apparatus as in claim 17, wherein said first elongated guide member has a generally parabolic shape.

19. An apparatus as in claim 18, further comprising a second locking means for maintaining the second elongated guide means in a desired position.

20. An apparatus as in claim 17, wherein said first end of said second elongated guide member is pivotally attached to the bottom surface of the top.

21. An apparatus as in claim 17, wherein said keyboard support means rotates in a range of from about 10 degrees to about 45 degrees measuring from the longitudinal axis of the short arm.

22. An apparatus comprising:

a base having an upper end, a lower end, and a leg assembly;

a top having a bottom surface attached to the upper end of the base; and a keyboard support means having a longitudinal axis pivotally attached to the top; and wherein the keyboard support means has an upper surface and a bottom surface, wherein said bottom surface of the keyboard support means is mounted to the bottom surface of the top by a generally L-shaped mounting means, said generally L-shaped mounting means having a short arm connected to a long arm, wherein said keyboard support means extends generally alongside the top; and wherein the long arm has a first end and a second end and said first end is pivotally connected to the bottom surface of the top, wherein said short arm has a first end pivotally connected to the bottom surface of the keyboard support means and a second end connected to the second end of the long arm; and wherein the long arm of the generally L-shaped mounting means has a first tubular member attached to the first end and forms a T-shaped head; wherein said tubular member is rotatably mounted to the bottom surface of the top by a bracket means that is fastened to the bottom surface of the top, wherein said tubular member has a longitudinal axis and extends in a plane that is parallel to the longitudinal axis of the top.

23. An apparatus as in claim 22, wherein said long arm is capable of rotating in a plane normal to the longitudinal axis of the top via a first pivot means, so that the keyboard support means can be adjusted in height by a user.

24. An apparatus as in claim 23, wherein said first pivot means comprises a first elongated guide member and a first shaft, said first shaft being fixed to the long arm of the generally L-shaped mounting means near the first end, said first elongated guide having a first end, a second end, and further including a slot extending between the first end and the second end, said first end being attached to the bottom surface of the top and a said slot being slidably received by the first shaft.

25. An apparatus as in claim 22, wherein said short arm has a first end pivotally connected to the bottom surface of the keyboard support means and a second end connected to the second end of the long arm.

26. An apparatus as in claim 25, wherein the short arm of the generally L-shaped mounting means further comprises a second tubular member having a longitudinal axis, said second tubular member being attached to the first end of the short arm to form a T-shaped head, wherein said second tubular member is rotatably mounted to the bottom surface of the keyboard means by a bracket means that is fastened to the bottom surface of the keyboard support means.

27. An apparatus as in claim 26, wherein said keyboard support means is capable of rotating about the longitudinal axis of the second tubular member in a plane that is normal to the longitudinal axis of the short arm, via a second pivot means, so that the centerline of the keyboard support means can be adjusted relative to the longitudinal axis of the short arm by a user.

28. An apparatus as in claim 27, wherein said second pivot means comprises a second elongated guide member and a second shaft, said second shaft being fixed to the short arm of the generally L-shaped mounting means near the first end, said second elongated guide member having a first end, a second end, and further including a slot extending between the first end and the second end, said first end being attached to the bottom surface of the top and a said second shaft being slidably received by the slot.

* * * * *